US007141091B2

(12) United States Patent
Chang

(10) Patent No.: US 7,141,091 B2
(45) Date of Patent: Nov. 28, 2006

(54) METHOD AND APPARATUS FOR REMOVING PARTICULATE AND VAPOR PHASE CONTAMINANTS FROM A GAS STREAM

(75) Inventor: Ramsay Chang, Los Altos, CA (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 76 days.

(21) Appl. No.: 10/740,330

(22) Filed: Dec. 17, 2003

(65) Prior Publication Data

US 2005/0132880 A1 Jun. 23, 2005

(51) Int. Cl.
*B03C 3/017* (2006.01)

(52) U.S. Cl. ..... 95/58; 95/134; 96/134; 96/135; 96/138

(58) Field of Classification Search ..... 95/58, 95/61, 62, 134; 96/27, 134–136, 138
See application file for complete search history.

(56) References Cited

U.S. PATENT DOCUMENTS

| | | | | |
|---|---|---|---|---|
| 1,016,476 | A * | 2/1912 | Cottrell | 95/58 |
| 2,357,354 | A * | 9/1944 | Penney | 96/27 |
| 2,949,168 | A * | 8/1960 | Peterson | 96/27 |
| 3,404,513 | A * | 10/1968 | Roberts | 96/27 |
| 4,006,066 | A * | 2/1977 | Sparwald | 205/391 |
| 4,072,477 | A * | 2/1978 | Hanson et al. | 95/71 |
| 4,154,585 | A * | 5/1979 | Melcher et al. | 96/27 |
| 4,193,774 | A * | 3/1980 | Pilat | 95/71 |
| 4,220,478 | A * | 9/1980 | Schuff | 106/284.04 |
| 5,024,681 | A | 6/1991 | Chang | 95/70 |
| 5,158,580 | A | 10/1992 | Chang | 95/70 |
| 5,308,590 | A * | 5/1994 | Kersey et al. | 422/170 |
| 5,332,562 | A * | 7/1994 | Kersey et al. | 423/210 |
| 5,409,522 | A | 4/1995 | Durham et al. | 75/670 |
| 5,505,766 | A | 4/1996 | Chang | 95/134 |
| 5,591,412 | A * | 1/1997 | Jones et al. | 422/171 |
| 5,827,352 | A | 10/1998 | Altman et al. | 95/58 |
| 5,854,173 | A | 12/1998 | Chang et al. | 502/417 |
| 5,948,143 | A | 9/1999 | Sjostrom et al. | 95/134 |
| 6,136,072 | A | 10/2000 | Sjostrom et al. | 95/134 |
| 6,451,094 | B1 | 9/2002 | Chang et al. | 95/901 |
| 6,500,240 | B1 * | 12/2002 | Tomimatsu et al. | 96/27 |
| 6,558,454 | B1 | 5/2003 | Chang et al. | 95/901 |
| 6,695,894 | B1 | 2/2004 | Chang et al. | 95/134 |
| 6,818,043 | B1 * | 11/2004 | Chang et al. | 95/37 |
| 6,905,534 | B1 * | 6/2005 | Chang et al. | 96/55 |

(Continued)

FOREIGN PATENT DOCUMENTS

| | | | | |
|---|---|---|---|---|
| JP | 53-5466 | * | 1/1978 | 96/27 |

*Primary Examiner*—Richard L. Chiesa
(74) *Attorney, Agent, or Firm*—Morgan, Lewis & Bockius LLP

(57) ABSTRACT

The present invention provides methods for removing particulate and a vapor phase contaminant from a gas stream including, in one embodiment, directing a gas stream comprising fly ash and a vapor phase contaminant into a particulate collection device, wherein the particulate collection device includes an upstream collection section and a downstream collection section; removing at least a portion of the fly ash from the gas stream in the upstream collection section; injecting a sorbent into the particulate control device between the upstream collection section and the downstream collection section; adsorbing the vapor phase contaminant onto the sorbent to produce spent sorbent; and removing the spent sorbent from the gas stream in the upstream collection section. An apparatus is also provided for performing the methods.

62 Claims, 4 Drawing Sheets

U.S. PATENT DOCUMENTS 6,953,494 B1 * 10/2005 Nelson, Jr. ..... 95/134
2002/0124725 A1 9/2002 Chang et al. ..... 95/107
2004/0045437 A1 3/2004 Chang et al. ..... 95/134

* cited by examiner

METHOD AND APPARATUS FOR REMOVING PARTICULATE AND VAPOR PHASE CONTAMINANTS FROM A GAS STREAM

BACKGROUND OF THE INVENTION

1. Field of the Invention

The present invention relates generally to the removal of particulate and vapor phase contaminants from a gas stream. More specifically, the present invention relates to the removal of particulates, such as fly ash and vapor phase contaminants, such as mercury, from a gas stream, such as a flue gas stream from a coal-fired boiler.

2. Description of Related Art

Utility power plants, in particular, coal-fired power plants, remove particulate matter, such as fly ash, from flue gas generated by the boiler before releasing the flue gas to the atmosphere. Typical methods for removing fly ash include the use of an electrostatic precipitator or baghouse filter. The collected fly ash must then be properly disposed of, taking into account its composition.

Utility power plants also are concerned about emission of trace metals in light of the 1990 Clean Air Act Amendment (CAAA) on air toxics (Title III). Special attention has been given to mercury (Hg) in terms of its environmental release and impacts, and the Environmental Protection Agency (EPA) is closely scrutinizing sources that emit mercury. Mercury is present in flue gas in very low concentrations (<1 ppb) and forms a number of volatile compounds that are difficult to remove. Specially designed and costly emissions-control systems are required to capture these trace amounts of volatile compounds effectively.

Several approaches have previously been adopted for removing mercury from gas streams. These techniques include passing the gas stream through a fixed or fluidized sorbent bed or structure or using a wet scrubbing system. The most common methods are often called "fixed bed" techniques. Approaches using fixed bed technologies normally pass the mercury containing gas through a bed consisting of sorbent particles or various structures such as honeycombs, screens, and fibers coated with sorbents. Common sorbents include activated carbon and noble metals such as gold and silver. In many cases where noble metals are used, only the surface layer of the sorbent structure is coated with the noble metal sorbent while the support underneath is made of ceramic or metallic materials. The sorbents in these fixed structures can be periodically regenerated by heating the structure and driving off the adsorbed mercury (see, for example, U.S. Pat. No. 5,409,522, entitled "Mercury Removal Apparatus and Method," which is incorporated herein by reference in its entirety). The mercury driven off can be recovered or removed separately.

There are, however, several disadvantages of fixed bed systems. Gas streams such as those from power plant coal combustion systems contain a significant amount of fly ash that can plug the bed structures and, thus, the beds need to be removed frequently from operation for cleaning. In addition, fixed bed systems may produce a significant pressure drop in the gas path.

Alternatively, these beds may be located downstream of a separate particulate collector (see, for example, U.S. Pat. No. 5,409,522). Particulate removal devices ensure that components of the flue gas such as fly ash are removed before the gas passes over the mercury removal device. The beds will also have to be taken off-line periodically for regeneration, thereby necessitating a second bed to remain on-line while the first one is regenerating. These beds also require significant space and are very difficult to retrofit into existing systems such as into the ductwork of powerplants without major modifications.

In another technique, a primary particulate control device pre-collects most of the ash present in a gas stream. A sorbent is then injected into the gas stream downstream of the primary particulate control device but at a location upstream of a baghouse. A removable filter bag in the baghouse is then coated with the injected sorbent and contaminants are adsorbed as they pass through the filter bag (see, for example, U.S. Pat. No. 5,505,766, entitled "Method for Removing Pollutants from a Combustor Flue Gas and System for Same," which is incorporated herein by reference in its entirety). In yet another technique, a porous tube of sorbent material is placed into the duct work through which the gas passes (see, for example, U.S. Pat. No. 5,948,143, entitled "Apparatus and Method for the Removal of Contaminants in Gases," which is incorporated herein by reference in its entirety). Such a technique permits the tube of sorbent materials to be cleaned and the sorbent to be regenerated in place without having to stop the gas flow by heating the sorbent in situ and driving off the contaminants. However, application of heat to the porous tube while it is in the duct is not a convenient technique.

In yet another technique, a sorbent structure is coated with a renewable layer of sorbent, in which a flue gas passes over the sorbent structure (see, for example, published U.S. Pat. Application 20020124725 entitled "Method and Apparatus for Renewable Mercury Sorption," which is incorporated herein by reference in its entirety). The sorbent structure can be a tube or plate and can be porous or non-porous and is placed inside a duct through which the flue gas flows.

In yet another process, a carbonaceous starting material is injected into a gas duct upstream of a particulate collection device. The carbonaceous starting material is activated in-situ and adsorbs contaminants. The activated material having the adsorbed contaminants is then collected in a particulate collection device. Such a process is described in U.S. Pat. Nos. 6,451,094 and 6,558,454, both entitled "Method for Removal of Vapor Phase Contaminants from a Gas Stream by In-Situ Activation of Carbon-Based Sorbents," which are both incorporated herein by reference in their entireties. In this process, however, both particulate or fly ash and the sorbent having the adsorbed contaminant are collected together in the same particulate collection device.

While there are existing methods for removing fly ash from a flue gas stream and method for removing vapor phase contaminants, there remains a need for an improved method and apparatus that removes both fly ash and vapor phase contaminants from a gas stream and that allows for separate removal and collection of the fly ash and the vapor phase contaminant.

SUMMARY OF THE INVENTION

Accordingly, the present invention provides a method and apparatus that are capable of removing both particulate or fly ash as well as one or more vapor phase contaminants, such as mercury, from a gas stream, such as a flue gas stream generated by a coal-fired boiler. Further, the present invention provides a method and apparatus for removing fly ash and one or more vapor phase contaminants adsorbed onto an injected sorbent, wherein the fly ash is collected separately from the vapor phase contaminants adsorbed onto the sorbent, thereby avoiding contamination of the fly ash by the sorbent having the adsorbed vapor phase contaminants, which provides for easier disposal of the collected fly ash.

In general, the present invention provides in one embodiment a method for removing fly ash and a vapor phase contaminant from a gas stream, comprising directing a gas stream comprising fly ash and a vapor phase contaminant into a particulate collection device, wherein the particulate collection device comprises an upstream collection section and a downstream collection section; removing at least a portion of the fly ash from the gas stream in the upstream collection section; injecting a sorbent into the particulate control device between the upstream collection section and the downstream collection section; adsorbing the vapor phase contaminant onto the sorbent to produce spent sorbent; and removing the spent sorbent from the gas stream in the upstream collection section. In other embodiments, the method further comprises converting the vapor phase contaminant to an absorbable form and absorbing the absorbable form of the vapor phase contaminant. In other embodiments, the method is performed within a single housing.

The present invention also provides an apparatus for removing particulate and a vapor phase contaminant from a gas stream, comprising a particulate collection device having a housing and comprising an upstream collecting section and a downstream collecting; and an injector configured to inject a sorbent between the upstream collecting section and the downstream collecting section. In another embodiment, the apparatus comprises a scrubber configured to remove an absorbable form of the vapor phase contaminant, wherein the scrubber is located downstream of and is fluidly connected to the particulate collection device.

Other features of the invention will appear from the following description from which the preferred embodiments are set forth in detail in conjunction with the accompanying drawings.

DESCRIPTION OF THE PREFERRED EMBODIMENTS

Generally, the present invention provides a method and apparatus for removing both particulate, such as fly ash, and vapor phase contaminants, such as trace metals including, for example, mercury, from a gas stream, such as flue gas stream from a coal-fired power plant. The following text in connection with the Figures describes various embodiments of the present invention. The following description, however, is not intended to limit the scope of the present invention. It should be appreciated that where the same numbers are used in different figures, these refer to the same element or structure.

Figure 1:
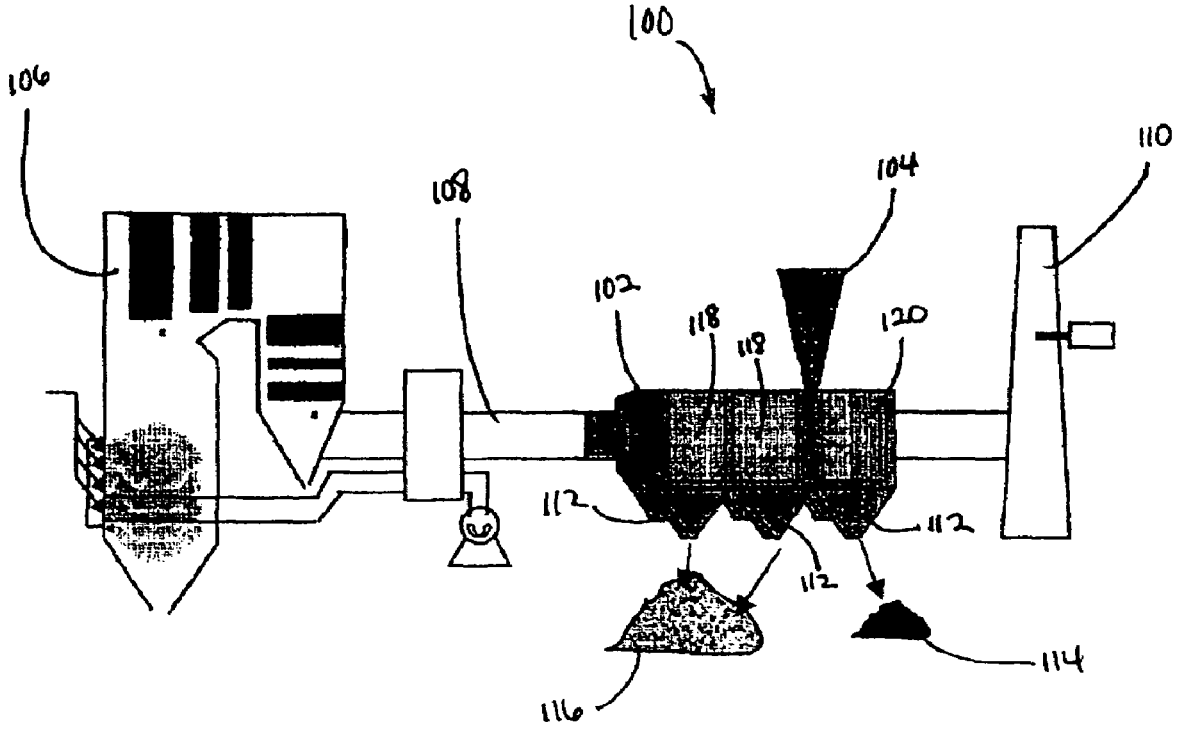
FIG. 1 is a process schematic of one embodiment of the present invention.

FIG. 1 is a schematic diagram of one embodiment of the present invention. In the coal combustion process 100, a coal-fired boiler 106 generates a flue gas that passes through a duct 108 and is directed to a particulate collection device 102 and finally to a stack 110 where the flue gas is discharged. An injector 104 is connected to the particulate collection device 102 and is configured to inject a sorbent into the gas stream as it passes through the particulate collection device 102. The particulate collection device 102 comprises an upstream collection section 118 that is located upstream of the location where the injector 104 injects the sorbent. The particulate collection device 102 also comprises a downstream collection section 120 that is located downstream of the location where the injector 104 injects the sorbent.

It should be appreciated that the particulate collection device 102, including the upstream collection section 118 and the downstream collection section 120 may be any type of collecting device. In one embodiment, the particulate collection device is an electrostatic precipitator where both the upstream collection section and the downstream collection section each comprise a plurality of collecting fields, referred to as "upstream collecting fields" and "downstream collecting fields," respectively. More specifically, in one embodiment, the collecting fields may comprise flat plates having discharge electrodes disposed between the plates. In another embodiment, the collecting fields may comprise tubular collection sections having discharge electrodes disposed in the center of the tubes.

In another embodiment, the upstream collection section comprises an electrostatic precipitator having a plurality of upstream collecting fields and the downstream collection section comprises a compact baghouse disposed within the same housing as the electrostatic precipitator. In yet another embodiment, the upstream collection section may comprise an electrostatic precipitator having a plurality of upstream collecting fields and the downstream collection section comprises a wet electrostatic precipitator. Further, in any of these embodiments, the upstream collection section may comprise a baghouse. It should also be appreciated that regardless of the particular devices used for the upstream collection section and the downstream collection section that, preferably, both sections are housed within the same structure or single housing without connecting ductwork between the sections. Further, it should be appreciated that an existing electrostatic precipitator having multiple collecting fields may have some of the downstream collecting fields replaced by a wet electrostatic precipitator or a compact baghouse.

In operation, the flue gas, which contains fly ash from the combustion process as well as one or more vapor phase contaminants such as mercury, is directed to the inlet of the particulate collection device 102, in this case, an electrostatic precipitator. The flue gas then passes by the plurality of upstream collecting fields 118 located upstream of the injector 104. As the flue gas passes by these upstream collecting fields, at least a portion of the fly ash is removed from the flue gas. For example, 50–90% of the fly ash, and preferably 70–90% of the fly ash, may be removed by these upstream collecting fields 118. More specifically, 50%, 70% or 90% of the fly ash may be removed by these upstream collecting fields 118. The fly ash that is removed may be collected in hoppers 112 to produce collected fly ash 116.

The injector 104 then injects a sorbent into the flue gas downstream of the upstream collecting fields 118. Therefore, the sorbent is being injected into a gas stream that contains a relatively low amount of fly ash. The sorbent is selected so that once it is injected into the gas stream it will adsorb one or more vapor phase contaminants to produce sorbent containing the vapor phase contaminant or "spent sorbent." For example, a carbon-based material, such as activated carbon, may be used as the sorbent to adsorb a vapor phase contaminant, such as mercury, from the flue gas. It should be appreciated, however, that other sorbents may be used alone or together to adsorb other trace metals or vapor phase contaminants.

The particle size of the sorbent should be fine enough to suspend the individual particles in the gas stream. Preferably, the particles are less than about 100 microns in size. More preferably, the particles are less than about 40 mm in size. The sorbent can be injected in either a dry powder form or as a wet slurry form, such that the heat of the gas stream will evaporate at least some of the suspending fluid, leaving the sorbent suspended in the gas stream.

It should be appreciated that the sorbent injector 104 is flexible in design and in implementation. Any means known by one skilled in the art can be used to inject sorbent into the electrostatic precipitator 102. The sorbent injector 104 should have some means to hold sorbent and some means to deliver sorbent into the electrostatic precipitator 102. For example, the sorbent injector 104 may be any mechanical or pneumatic device, such as a pump or blower, that can be operated manually or by automatic control.

The location at which the sorbent is injected can vary, as long as the sorbent is injected between the upstream collection section and the downstream collection section. In the embodiment where the particulate collection device comprises an electrostatic precipitator, the sorbent is injected downstream of a least one collecting field and upstream of at least one collecting field. Preferably, however, there is more than one collecting field upstream of the injection point and more than one collecting field downstream of the injection point. The number of collecting fields on either side of the injection location, however, can be determined based upon the particulate or fly ash loading of the flue gas as well as the concentration of the vapor phase contaminant to be removed. For example, a higher mercury concentration may require a higher amount of sorbent to be injected, thereby requiring a higher number of collecting fields downstream of the injection point. Further, a higher particulate loading may require a higher number of collecting fields upstream of the injection point.

The sorbent may also be injected into the gas stream through one or more injection ports. As such, the injector 104 may have one or more injectors that each inject the sorbent at a different location about the housing 102 of the electrostatic precipitator. For example, multiple injectors may be used at multiple locations around the housing 102 (e.g., both sides and the top of the housing) but where all of these locations are all at approximately the same location relative to the gas path and are still between the upstream collection section 118 and downstream collection section 120. It should be appreciated that when using more than one injection location or injector, different types of sorbent may be injected through each injector to provide for removal of different vapor phase contaminants.

Alternatively, sorbent may be injected downstream of the upstream collection section but at multiple locations along the gas path and, in the embodiment where the downstream collection section comprises an electrostatic precipitator having a plurality of collecting fields, sorbent may be injected between several of the downstream collecting fields. For example, a first injection location could be immediately upstream of a first downstream collecting field. A second injection location could be downstream of this first downstream collecting field but upstream of a second downstream collecting field and so on. It should be appreciated that when using more than one injection location or injector, different types of sorbent may be injected through each injector to provide for removal of different vapor phase contaminants.

It should be appreciated that the injected sorbent and the spent sorbent are suspended and carried by the flue gas and pass by the downstream collection section 120. The downstream collection section 120 acts to remove at least a portion of the spent sorbent from the flue gas. A hopper 112 is used to facilitate the collection of the spent sorbent to produce collected spent sorbent 114. It should also be appreciated that a portion of the sorbent after it is collected continues to adsorb vapor phase contaminants. For example, when the downstream collection section comprises an electrostatic precipitator, sorbent collected by the downstream collecting field may continue to adsorb vapor phase contaminants. When the downstream collection section comprises a compact baghouse, the sorbent collected by the filter bag may continue to adsorb vapor phase contaminants.

It should be appreciated that by removing a majority of the fly ash upstream of the point where the sorbent is injected provides a collected fly ash that is not contaminated by spent sorbent. In other words, the collected fly ash may be more easily disposed of since it would be substantially free of adsorbed vapor phase contaminants such as mercury. Moreover, the volume or weight of the collected spent sorbent is much lower since it does not contain as much fly ash compared to a process where both the fly ash and spent sorbent are removed together. This allows for more efficient processing of the spent sorbent, for example, recovery of the mercury or even regeneration of the sorbent.

As noted above, it should also be appreciated that in another embodiment the downstream collection section 120 may comprise a compact baghouse that is housed within the same structure 102 as the upstream collecting section, such as an electrostatic precipitator having a plurality of collecting fields. Such a combination of electrostatic precipitator collecting fields and a baghouse is described in U.S. Pat. No. 5,024,681, entitled "Compact Hybrid Particulate Collector," and U.S. Pat. No. 5,158,580 entitled "Compact Hybrid Particulate Collector (COHPAC), both of which are incorporated by reference herein in their entirety. In this particular embodiment, the sorbent injector injects sorbent in a location downstream of the electrostatic precipitator but upstream of the compact baghouse. The fly ash is primarily collected by the electrostatic precipitator before the point of sorbent injection. As described above, the collected fly ash will be free of spent sorbent having adsorbed vapor phase contaminants. The compact baghouse then serves to collect the injected sorbent having adsorbed vapor phase contaminants.

Also as noted above, in another embodiment, the downstream collection section 120 may comprise a wet electrostatic precipitator that is housed within the same structure 102 as the upstream collecting section, such as an electrostatic precipitator (dry) having a plurality of collecting fields. In this particular embodiment, the sorbent injector injects sorbent in a location downstream of the electrostatic precipitator but upstream of the wet electrostatic precipitator. The fly ash is primarily collected by the electrostatic precipitator before the point of sorbent injection. As described above, the collected fly ash will be free of spent sorbent having adsorbed vapor phase contaminants. The wet electrostatic precipitator then serves to collect the injected sorbent having adsorbed vapor phase contaminants.

Additionally, a wet electrostatic precipitator may also scrub or absorb additional vapor phase contaminants from the gas stream that are capable of being absorbed. Importantly, it has been discovered that activated carbon acts to convert elemental or metallic mercury to an oxidized form that is capable of being absorbed by a scrubber. Such an absorbable form of mercury may, therefore, be scrubbed from the flue gas by a wet electrostatic precipitator.

Figure 2:
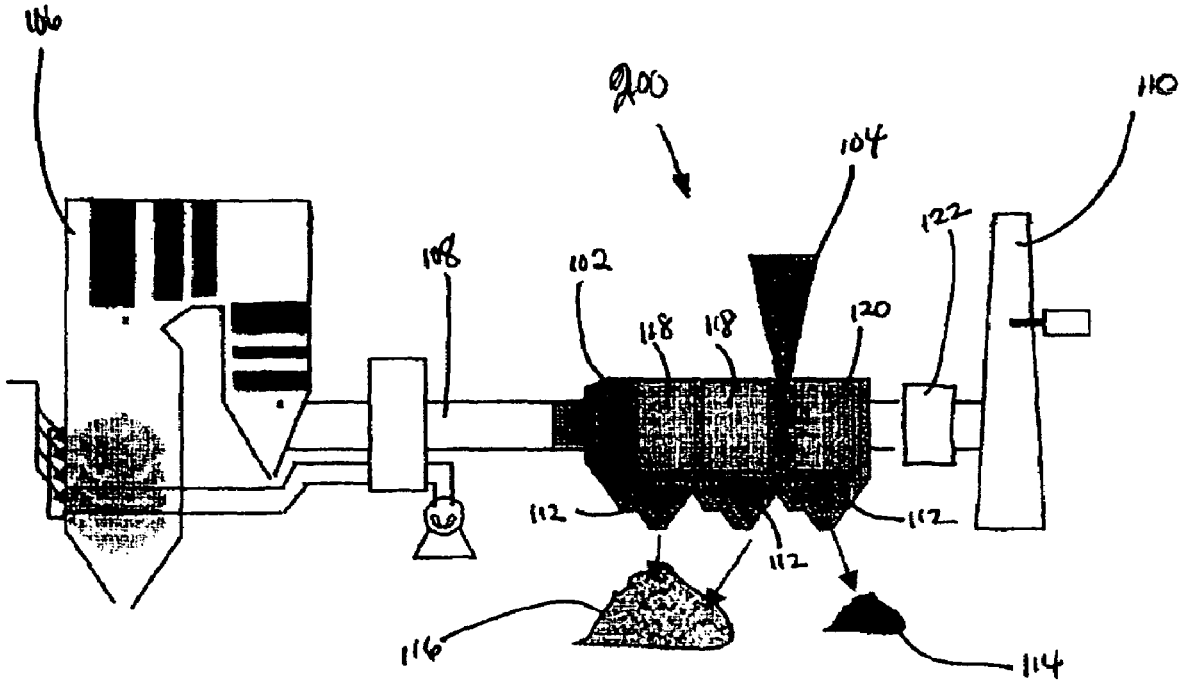
FIG. 2 is a process schematic of another embodiment of the present invention.

FIG. 2 is a process schematic of another embodiment of the present invention. This embodiment is similar to the embodiments described in connection with FIG. 1; however, a scrubber 122 is located downstream of the particulate collection device 102. In this embodiment, the sorbent is used to catalyze or to facilitate conversion of a vapor phase contaminant into an absorbable form that can then be absorbed using the scrubber 122. As noted above, activated carbon when injected as a sorbent by the injector 104 acts to catalyze the conversion of vaporous elemental or metallic mercury to a vaporous oxidized form of mercury, which is much more soluble than the elemental form. As such, vapor phase mercury oxide contaminants are more readily absorbed by the scrubber 122, which may be either a wet scrubber or a dry scrubber. It should be appreciated that in this embodiment the upstream and downstream collecting sections may alternatively be separately housed.

In operation, fly ash is removed using the upstream collection section 118. Mercury is removed by adsorption onto an activated carbon sorbent that has been injected into the gas stream by the injector 104 and the spent sorbent is collected by the downstream collecting section 120. The injected sorbent also acts to convert elemental mercury that is not adsorbed into an oxidized form of mercury. This oxidized form is then carried with the gas to the scrubber 122 where it is scrubbed from the gas stream. As described in connection with FIG. 1, the embodiment of FIG. 2 also allows for the collection of fly ash that has not been contaminated by the removal of spent sorbent, thereby providing for easier disposal of the collected fly ash. It should be appreciated that the upstream and downstream collection sections of the particulate collection device 102 in this embodiment may also comprise various particulate collection methods and devices, such as, an electrostatic precipitator, an electrostatic precipitator followed by a compact baghouse or an electrostatic precipitator followed by a wet electrostatic precipitator.

It should also be appreciated that the implementation of a scrubber 122 is not limited to instances when activated carbon is the selected sorbent. The inclusion of a scrubber 122 can be utilized in any embodiment of the present invention for additional removal of mercury or other vapor phase contaminants, regardless of the sorbent selection. Further, additional sorbents can be selected to convert other vapor phase contaminants into soluble forms that can be scrubbed from the flue gas by the scrubber 122.

Figure 3:
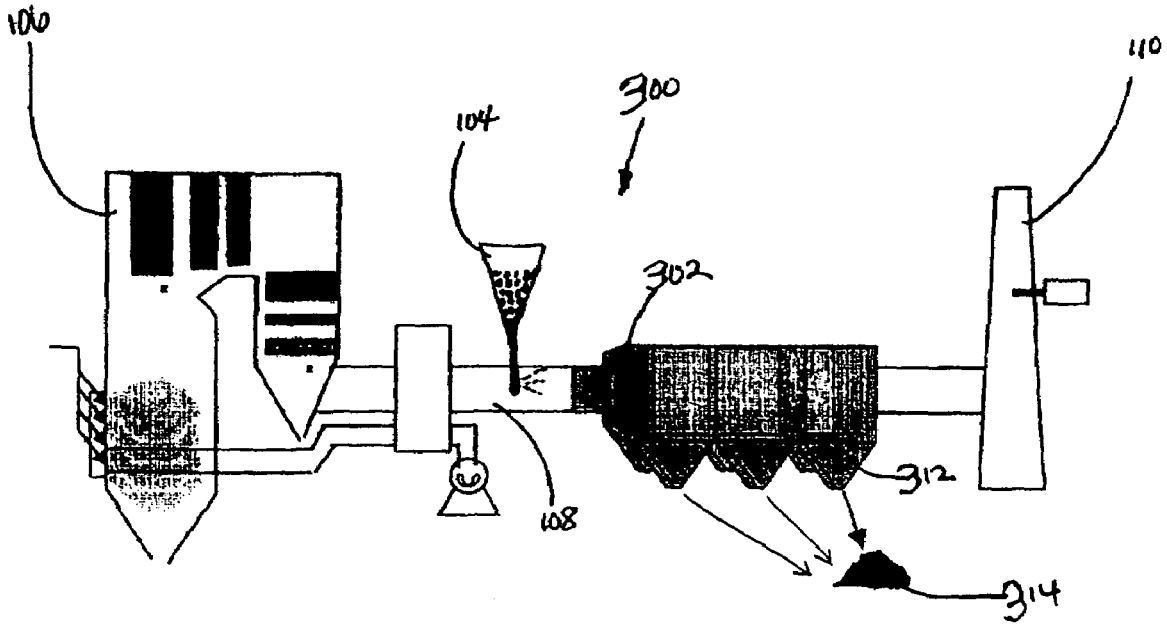
FIG. 3 is a process schematic of another embodiment of the present invention.

FIG. 3 is a process schematic of another embodiment of the present invention. In this process 300, the injector 104 is located upstream of the particulate collection device 302. The particulate collection device 302 may be any device capable of separating particulate from the gas stream, such as an electrostatic precipitator or baghouse. In this configuration, the injected sorbent will adsorb the vapor phase contaminant to produce spent sorbent, which can then be collected in the particulate collection device 302. It should be appreciated that in this embodiment, both fly ash and spent sorbent are collected together in the particulate collection device 302 using hoppers 312 to produce collected particulate 314. Therefore, there is no segregation of these materials in this embodiment. It should be appreciated that the particulate collection device 302 may comprise upstream and downstream collection sections that may be configured as described in connection with FIG. 1.

Figure 4:
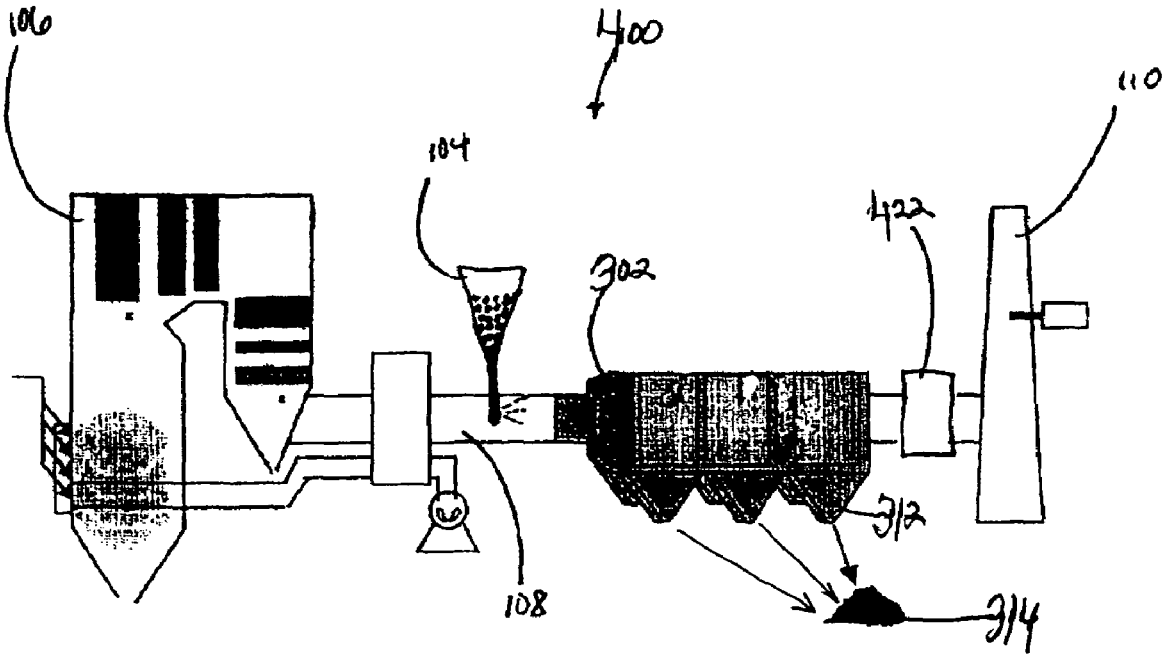
FIG. 4 is a process schematic of another embodiment of the present invention.

FIG. 4 is a process schematic of another embodiment of the present invention. This embodiment is similar to the process described in connection with FIG. 3, except that a scrubber 422 is located downstream of the particulate collection device 302. Similar to the process described in connection with FIG. 2, the sorbent injected by injector 104 is selected and utilized to catalyze or facilitate the conversion of a vapor phase contaminant into an absorbable form. For example, activated carbon may be used as the sorbent to convert elemental or metallic mercury into an oxidized form of mercury that is more soluble than the elemental form and more easily scrubbed from the gas stream by a scrubber 422. The scrubber may be a wet scrubber or a dry scrubber. It should be appreciated that the particulate collection device 302 may comprise upstream and downstream collection sections that may be configured as described in connection with FIG. 1, including, for example, separately housing the upstream and downstream collecting sections.

It should be appreciated that in this embodiment, the sorbent is also used to adsorb one or more vapor phase contaminants from the gas. This spent sorbent is then collected in the particulate collection device 302. As described in connection with FIG. 3, it should be appreciated that in this embodiment, both fly ash and spent sorbent are collected together in the particulate collection device 302 using hoppers 312 to produce collected particulate 314. Therefore, there is no segregation of these materials in this embodiment.

Various embodiments of the invention have been described. The descriptions are intended to be illustrative of the present invention. It will be apparent to one of skill in the art that modifications may be made to the invention as described without departing from the scope of the claims set out below. For example, it is to be understood that although some of the embodiments of the present invention have been described in the context of mercury removal, it should be appreciated that other vapor phase contaminants may be removed using the same method and apparatus with the selection of an appropriate sorbent.

What is claimed is:

1. A method for removing fly ash and a vapor phase contaminant from a gas stream, comprising:

directing a gas stream comprising fly ash and a vapor phase contaminant into a single particulate collection device, wherein said particulate collection device comprises an upstream collection section and a downstream collection section;

removing at least a portion of said fly ash from said gas stream in said upstream collection section;

injecting a dry sorbent into said particulate control device between said upstream collection section and said downstream collection section;

adsorbing said vapor phase contaminant onto said dry sorbent to produce spent sorbent; and removing said spent sorbent from said gas stream in said downstream collection section.

2. The method of claim 1, wherein said upstream collection section comprises a first electrostatic precipitator comprising a first plurality of collecting fields and wherein said downstream collection section comprises a second electrostatic precipitator comprising a second plurality of collecting fields.

3. The method of claim 2, wherein said first and said second plurality of collecting fields each comprise a plurality of flat plates and further comprising a plurality of discharge electrodes disposed between each of said flat plates.

4. The method of claim 2, wherein said first and said plurality of collecting fields each comprise a plurality of tubular collection sections and further comprising a plurality of discharge electrodes disposed in the center each of said tubular collection sections.

5. The method of claim 1, wherein said upstream collection section comprises an electrostatic precipitator and wherein said downstream collection section comprises a wet electrostatic precipitator.

6. The method of claim 1, wherein said upstream collection section comprises an electrostatic precipitator and wherein said downstream collection section comprises a compact baghouse.

7. The method of claim 1, wherein said removing at least a portion of said fly ash comprises removing at least approximately 50–90% of said fly ash; said gas stream comprises a gas stream from a coal-fired boiler; and said 50–90% is based upon fly ash exiting said coal-fired boiler.

8. The method of claim 1, wherein said removing at least a portion of said fly ash is performed separately from said removing said spent sorbent and wherein said removing at least a portion of said fly ash produces removed fly ash, and further comprising collecting said removed fly ash.

9. The method of claim 1, wherein said vapor-phase contaminant comprises mercury.

10. The method of claim 1, wherein said dry sorbent comprises a carbon-based sorbent.

11. The method of claim 10, wherein said carbon-based sorbent comprises activated carbon.

12. The method of claim 1, further comprising converting said vapor phase contaminant to an absorbable form.

13. The method of claim 12, wherein said vapor phase contaminant comprises elemental mercury and wherein said converting comprises converting said elemental mercury to an oxidized form of mercury.

14. The method of claim 13, wherein said converting is catalyzed by said sorbent.

15. The method of claim 14, wherein said dry sorbent comprises activated carbon.

16. The method of claim 15, further comprising absorbing said oxidized form of mercury.

17. The method of claim 16, wherein said absorbing comprises absorbing said oxidized form of mercury using a wet scrubber.

18. The method of claim 16, wherein said absorbing comprises absorbing said oxidized form of mercury using a dry scrubber.

19. The method of claim 12, further comprising absorbing said absorbable form of said vapor phase contaminant.

20. The method of claim 5, wherein said removing at least a portion of said fly ash is performed separately from said removing said spent sorbent and wherein said removing at least a portion of said fly ash produces removed fly ash, and further comprising collecting said removed fly ash.

21. The method of claim 5, further comprising converting said vapor phase contaminant to an absorbable form.

22. The method of claim 21, wherein said vapor phase contaminant comprises elemental mercury and wherein said converting comprises converting said elemental mercury to an oxidized form of mercury.

23. The method of claim 22, wherein said converting is catalyzed by said sorbent.

24. The method of claim 23, wherein said dry sorbent comprises activated carbon.

25. The method of claim 24, further comprising absorbing said oxidized form of mercury.

26. The method of claim 25, wherein said absorbing comprises absorbing said oxidized form of mercury using said wet electrostatic precipitator.

27. The method of claim 21, further comprising absorbing said absorbable form of said vapor phase contaminant.

28. The method of claim 2, wherein said removing at least a portion of said fly ash is performed separately from said removing said spent sorbent and wherein said removing at least a portion of said fly ash produces removed fly ash, and further comprising collecting said removed fly ash.

29. The method of claim 2, further comprising converting said vapor phase contaminant to an absorbable form.

30. The method of claim 29, wherein said vapor phase contaminant comprises elemental mercury and wherein said converting comprises converting said elemental mercury to an oxidized form of mercury.

31. The method of claim 30, wherein said converting is catalyzed by said sorbent.

32. The method of claim 31, wherein said dry sorbent comprises activated carbon.

33. The method of claim 32, further comprising absorbing said oxidized form of mercury.

34. The method of claim 33, wherein said absorbing comprises absorbing said oxidized form of mercury.

35. The method of claim 29, further comprising absorbing said absorbable form of said vapor phase contaminant.

36. A method for removing fly ash and a vapor phase contaminant from a gas stream, comprising:

directing a gas stream comprising fly ash and a vapor phase contaminant into a particulate collection device, wherein said particulate collection device comprises a single housing having an upstream collection section comprising an electrostatic precipitator and a downstream collection section comprising a compact baghouse;

removing at least a portion of said fly ash from said gas stream in said electrostatic precipitator;

injecting a sorbent into said particulate control device between said electrostatic precipitator and said compact baghouse;

adsorbing said vapor phase contaminant onto said sorbent to produce spent sorbent; and removing said spent sorbent from said gas stream in said compact baghouse.

37. The method of claim 36, wherein said removing at least a portion of said fly ash is performed separately from said removing said spent sorbent and wherein said removing at least a portion of said fly ash produces removed fly ash, and further comprising collecting said removed fly ash.

38. The method of claim 36, further comprising converting said vapor phase contaminant to an absorbable form.

39. The method of claim 38, wherein said vapor phase contaminant comprises elemental mercury and wherein said converting comprises converting said elemental mercury to an oxidized form of mercury.

40. The method of claim 39, wherein said converting is catalyzed by said sorbent.

41. The method of claim 40, wherein said sorbent comprises activated carbon.

42. The method of claim 41, further comprising absorbing said oxidized form of mercury.

43. The method of claim 42, wherein said absorbing comprises absorbing said oxidized form of mercury using a wet scrubber.

44. The method of claim 42, wherein said absorbing comprises absorbing said oxidized form of mercury using a dry scrubber.

45. The method of claim 38, further comprising absorbing said absorbable form of said vapor phase contaminant.

46. A method for separately removing fly ash and a vapor phase contaminant from a flue gas, comprising:

removing at least a portion of fly ash from a gas stream to produce removed fly ash;

collecting said removed fly ash to produce disposable fly ash;

injecting a dry sorbent into said gas stream after said removing;

adsorbing a vapor phase contaminant from said gas stream onto said dry sorbent to produce a spent sorbent;

removing said spent sorbent from said gas stream; and wherein said removing at least a portion of said fly ash, said collecting, said injecting, said adsorbing and said removing of said spent sorbent are performed within a single housing.

47. The method of claim 46, further comprising collecting said spent sorbent.

48. A method for removing fly ash and a vapor phase contaminant from a gas stream, comprising:

directing a gas stream comprising fly ash and a vapor phase contaminant into a single particulate collection device configured for horizontal gas flow, wherein said particulate collection device comprises an upstream collection section and a downstream collection section;

removing at least a portion of said fly ash from said gas stream in said upstream collection section;

injecting a dry powder sorbent into said particulate control device between said upstream collection section and said downstream collection section;

adsorbing said vapor phase contaminant onto said dry powder sorbent to produce spent sorbent; and removing said spent sorbent from said gas stream in said downstream collection section.

49. The method of claim 48, wherein said upstream collection section comprises an electrostatic precipitator.

50. The method of claim 49, wherein said downstream collection section comprises a compact baghouse.

51. The method of claim 49, wherein said downstream collection section comprises a second electrostatic precipitator.

52. The method of claim 49, wherein said downstream collection section comprises a wet electrostatic precipitator.

53. The method of claim 48, wherein said removing at least a portion of said fly ash is performed separately from said removing said spent sorbent and wherein said removing at least a portion of said fly ash produces removed fly ash, and further comprising collecting said removed fly ash.

54. The method of claim 48, wherein said dry powder sorbent comprises a carbon-based sorbent.

55. The method of claim 54, wherein said carbon-based sorbent comprises activated carbon.

56. The method of claim 48, further comprising converting said vapor phase contaminant to an absorbable form.

57. The method of claim 56, wherein said vapor phase contaminant comprises elemental mercury and wherein said converting comprises converting said elemental mercury to an oxidized form of mercury.

58. The method of claim 57, wherein said converting is catalyzed by said sorbent.

59. The method of claim 58, wherein said dry powder sorbent comprises activated carbon.

60. The method of claim 59, further comprising absorbing said oxidized form of mercury.

61. The method of claim 60, wherein said upstream collection section comprises an electrostatic precipitator, said downstream collection section comprises a wet electrostatic precipitator, and said absorbing comprises absorbing said oxidized form of mercury using said wet electrostatic precipitator.

62. The method of claim 56, further comprising absorbing said absorbable form of said vapor phase contaminant.

* * * * *